US011525634B2

(12) United States Patent
Rice

(10) Patent No.: US 11,525,634 B2
(45) Date of Patent: Dec. 13, 2022

(54) TWO-ORIENTATION CONDENSER FOR ENHANCED GRAVITY DRIVEN FILM CONDENSATION

(71) Applicant: J R Thermal, LLC, Austin, TX (US)

(72) Inventor: Jeremy Rice, Austin, TX (US)

(73) Assignee: J R Thermal, LLC, Austin, TX (US)

( * ) Notice: Subject to any disclaimer, the term of this patent is extended or adjusted under 35 U.S.C. 154(b) by 251 days.

(21) Appl. No.: 16/803,620

(22) Filed: Feb. 27, 2020

(65) Prior Publication Data

US 2020/0271390 A1 Aug. 27, 2020

Related U.S. Application Data

(60) Provisional application No. 62/811,231, filed on Feb. 27, 2019.

(51) Int. Cl.
*F28D 15/02* (2006.01)
*F28F 3/02* (2006.01)

(52) U.S. Cl.
CPC ..... *F28D 15/025* (2013.01); *F28D 15/0266* (2013.01); *F28F 3/027* (2013.01); *F28D 2015/0216* (2013.01)

(58) Field of Classification Search
CPC ..... F28D 15/025; F28D 15/0266; F28D 2015/0216; F28F 3/027
USPC ..... 165/104.22
See application file for complete search history.

(56) References Cited

U.S. PATENT DOCUMENTS

2008/0196865 A1* 8/2008 Miyagawa ..... F28D 15/043 165/104.21
2013/0077245 A1* 3/2013 Gradinger ..... H01L 23/427 165/170
2015/0241094 A1 8/2015 Blomberg et al.
2016/0123637 A1 5/2016 Moreno et al.
2016/0245593 A1 8/2016 Rice
2019/0193213 A1* 6/2019 Omi ..... F28D 15/0283
2021/0368647 A1* 11/2021 Boucher ..... H05K 7/20309

OTHER PUBLICATIONS

International Search Report and Written Opinion dated Jun. 26, 2020, in corresponding International Patent Application No. PCT/US2020/020181.

* cited by examiner

*Primary Examiner* — Justin M Jonaitis
(74) *Attorney, Agent, or Firm* — DuBois, Bryant & Campbell, LLP; William D. Wiese

(57) ABSTRACT

An enhanced gravity-driven, thin film condensation heat transfer condenser is disclosed for use in a thermosyphon performing in two perpendicular orientations, as well as orientations in between. The thermosyphon includes an evaporator fluidly coupled to a first condenser configured with a plurality of fins, with each of the plurality of fins having notches adjacent to flanges, the notches forming vapor flow channels through the plurality of fins. The first condenser is fluidly coupled to a second condenser, and vapor flowing from the evaporator must first pass through the first condenser before entering the second condenser.

9 Claims, 11 Drawing Sheets

TWO-ORIENTATION CONDENSER FOR ENHANCED GRAVITY DRIVEN FILM CONDENSATION

PRIORITY STATEMENT UNDER 35 U.S.C. § 119 & 37 C.F.R. § 1.78

This non-provisional application claims priority based upon prior U.S. Provisional Patent Application Ser. No. 62/811,231 filed Feb. 27, 2019 in the name of Jeremy Rice entitled "TWO-ORIENTATION CONDENSER FOR ENHANCED GRAVITY DRIVEN FILM CONDENSATION," the disclosures of which are incorporated herein in their entirety by reference as if fully set forth herein.

BACKGROUND OF THE INVENTION

Condensers known in the art can be effective when oriented in one direction but much less effective when oriented in another direction. For example, a condenser known in the art consisting of several parallel channels 102, with each channel having two side surfaces 103, a top surface 104 and a bottom surface 105, is shown in FIG. 1A. The channels 102 are rectangular in shape, in the orientation represented, the long sides (side surfaces) 103 are parallel to gravity. Since they are parallel to gravity, the gravity drives the liquid 107 down the wall and helps keep the liquid film thin, which is needed for effective condensate film heat transfer. The liquid 107 is thicker on the top surface 104 and bottom surface 105, since gravity does not aid in the movement of fluid flow on these surfaces, making these surfaces have diminished effectiveness of removing heat. Heat is removed from the condenser 101 by a coolant 106 passing over the top surface 104 and bottom surface 105. Enhancement fins are not represented in this schematic but are likely to be utilized.

The same condenser 101, rotated 90 degrees is presented in FIG. 1B. The side walls 103 of the rectangular channels are now the short sides and the top surface 104 and bottom surface 105 are the long sides of the rectangular channels. Since gravity assists the flow of the condensate film on the side walls 103, the liquid 107 condensate thickness tends to be quite thick on the top surface 104 and bottom surface105. Thick condensate can eliminate the effectiveness of heat removal from a surface. For example, in the representation shown in FIG. 1B, eighty percent of the channel surface is ineffective because of orientation.

SUMMARY OF THE INVENTION

The present invention aids in creating efficient condensation heat transfer in a condenser intended to operate in one or two orientations. The invention relates to condensers with parallel, generally rectangular cross-sectioned flow channels, where the surface created by the long edge of the rectangular cross-sectioned channel is normal to gravity in a first intended orientation of use. These flow channels are created by a fin stack between first and second covers or plates. The fins have folded features protruding normally to the surface of the fin, into the flow channel, near the top and bottom cover. These folded features enable gravity to promote a thin condensate film thickness, in a first intended orientation of use.

The foregoing has outlined rather broadly certain aspects of the present invention in order that the detailed description of the invention that follows may better be understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention.

It should also be realized by those skilled in the art that such equivalent constructions do not depart from the spirit and scope of the invention as set forth in the appended claims.

DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

The present invention is directed to an improved intermittent thermosyphon. The configuration and use of the presently preferred embodiments are discussed in detail below. It should be appreciated, however, that the present invention provides many applicable inventive concepts that can be embodied in a wide variety of contexts other than an intermittent thermosyphon. Accordingly, the specific embodiments discussed are merely illustrative of specific ways to make and use the invention, and do not limit the scope of the invention.

Figure 1A:
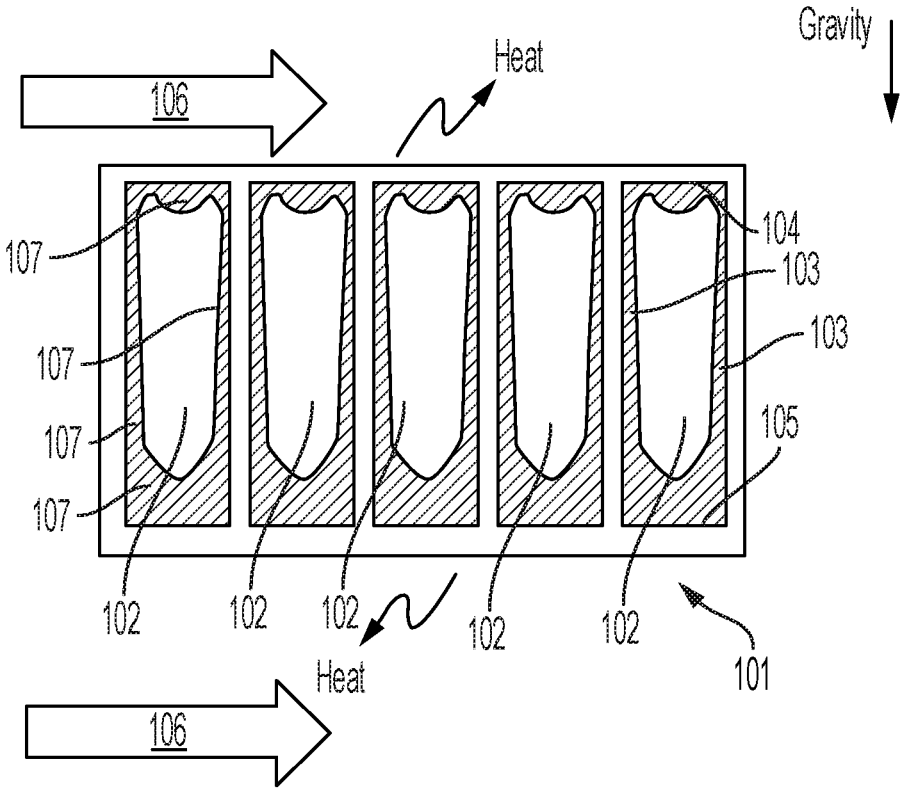
FIG. 1A is a schematic view of a condenser with channels in accordance with prior art.
Figure 1B:
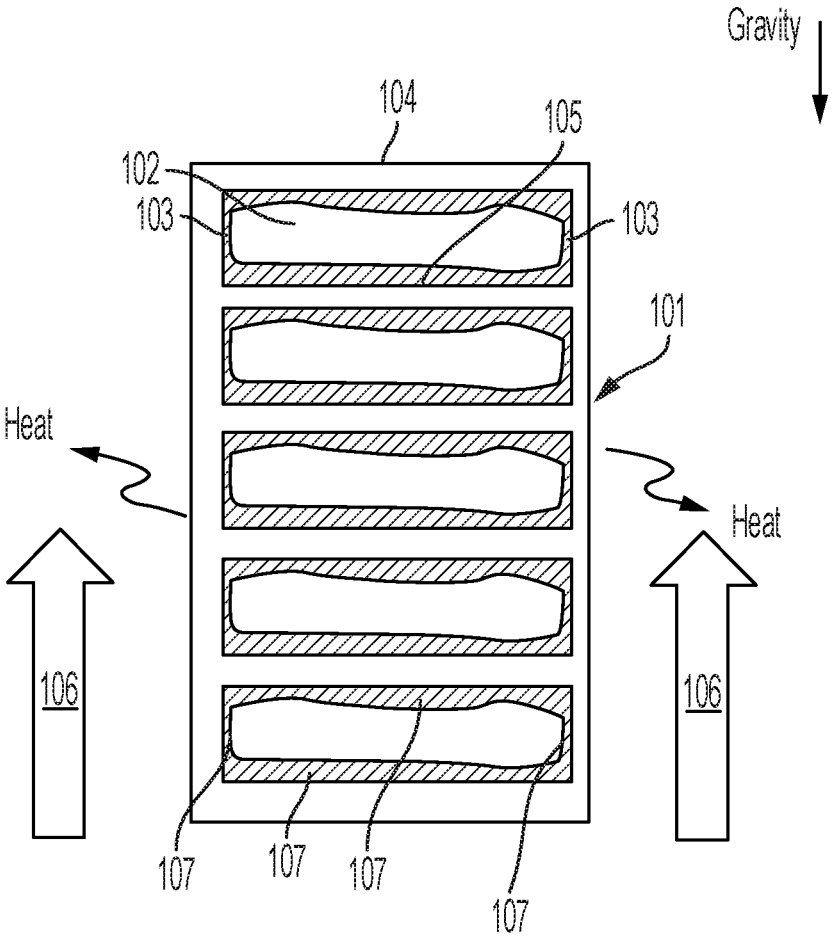
FIG. 1B is a schematic view of an alternate orientation of a condenser with channels in accordance with prior art.
Figure 2:
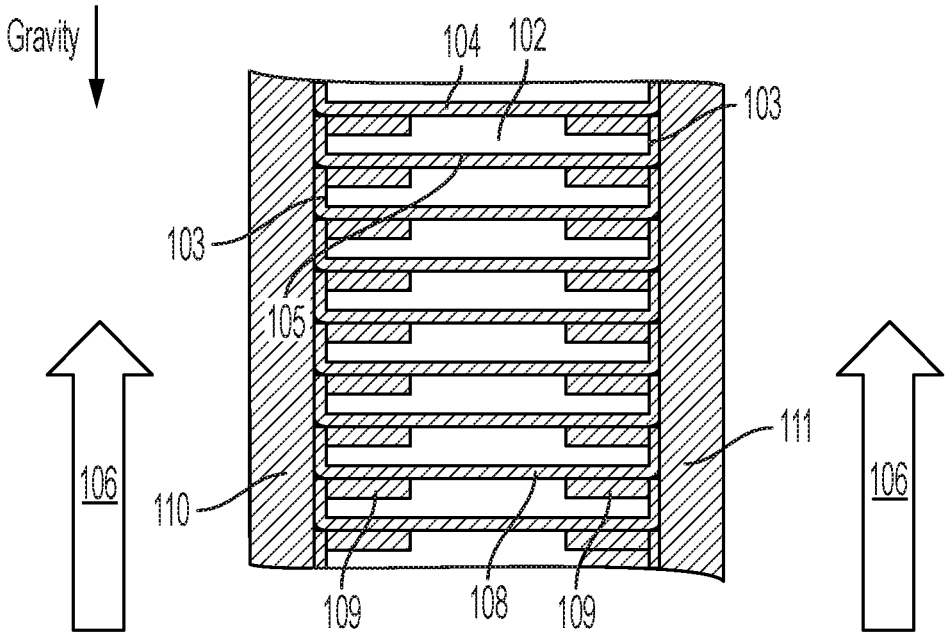
FIG. 2 is a cross sectional schematic view of the condenser in the first orientation of one embodiment of the present invention.

A cross-sectional view of a first orientation of one embodiment of the present invention is presented in FIG. 2. The condenser is configured with several parallel vapor flow channels 102, each of which has a general rectangular cross-sectional shape. The flow channels 102 are constructed by a series of fins 108 that are affixed to a first cover 110 (or plate) and a second cover 111 (or plate). The flow channels 102 have two side surfaces 103 that are perpendicular to the first cover 110 and the second cover 111 and are relatively short in comparison to the first cover 110 and second cover 111. The longer first cover 110 and second cover 111 are normal to gravity in the orientation shown in FIG. 2. Since the largest surface area is normal to gravity, a condensate film will tend to be thick and detrimental to effective condensation heat transfer without further consideration. To enhance condensation heat transfer in this orientation, a series of flanges 109 are added to the fins 108. These flanges 109, occupy only a portion of the fins 108 that are located closest to both the first cover 110 and second cover 111, as to allow vapor to flow freely and unobstructed by these flanges 109 in the central portion of the channels 102.

In this exemplary embodiment, the spacing between the first cover 110 and the second cover 111 is approximately 11 mm, and may range from 6 mm to 15 mm. The spacing may be reduced below 6 mm, but this may limit the surface available for the flanges 109 without having the flanges 109 block the vapor flowing in the channels 102. The fin pitch shown in FIG. 2 is 1.0 mm and may range from 0.7 mm to 4 mm. Smaller or larger fin pitches are possible, but may lead to decreased performance because of limited flange length in the former, and too little overall fin area in the latter. In this embodiment, the fin thickness is approximately 0.3 mm, and can trend from 0.1 mm to 0.5 mm. Larger than 0.5 mm may be difficult to form into a fin stack and thinner than 0.1 mm may lead to low fin efficiencies and a low structural strength of the condenser.

Those skilled in the art will appreciate that the orientation of the condenser presented in FIG. 2 can be rotated 90 degrees, to a second orientation, and the longer first cover 110 and second cover 111, will become the side surfaces of the cross-section, where gravity will act to drive condensate, and create a thin condensate film.

Figure 3:
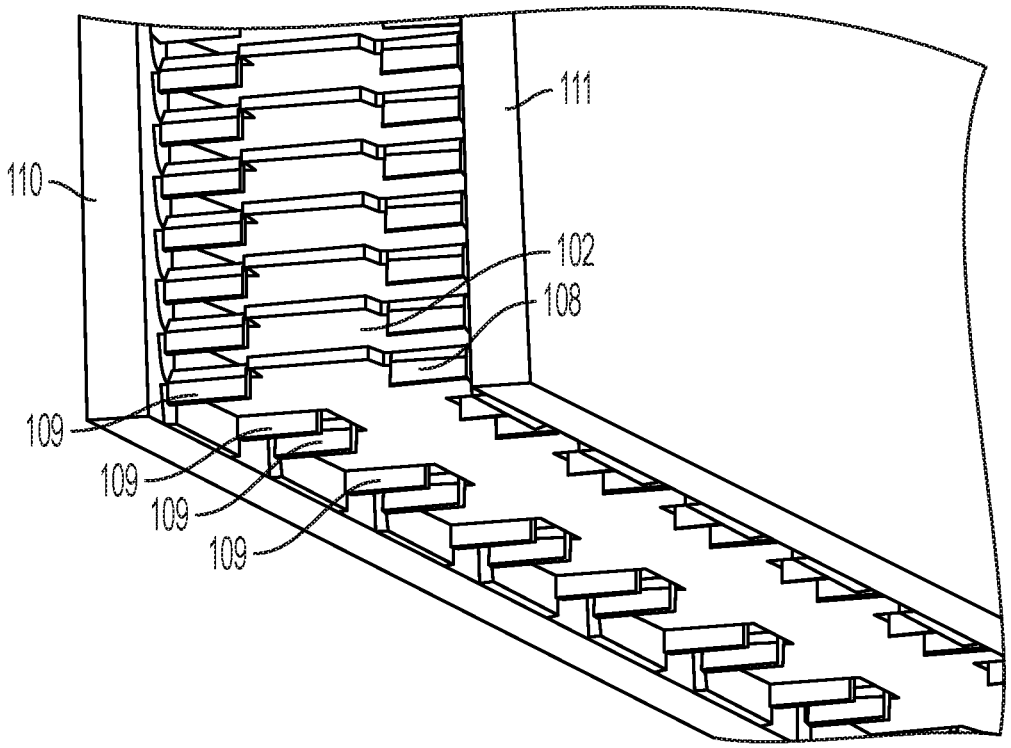
FIG. 3 is an isometric schematic view of a cross-section of one embodiment of the condenser of the present invention.

An isometric view of one embodiment of a dual cross-sectioned condenser is presented in FIG. 3. In this view, both the cross-section of the flow channels 102 are illustrated, as well as the surface of the fins 108 creating the flow channels 102. The series of flanges 109 protruding from the large fin 108 surface give continually good heat transfer along the length of the flow channel 102. These flanges 108 are proximate to the first cover 110 and second cover 111, along the entire length, with exception where additional features may be required to introduce vapor, for liquid to leave, or for refrigerant (liquid or vapor) to turn direction within the condenser 101.

Figure 4:
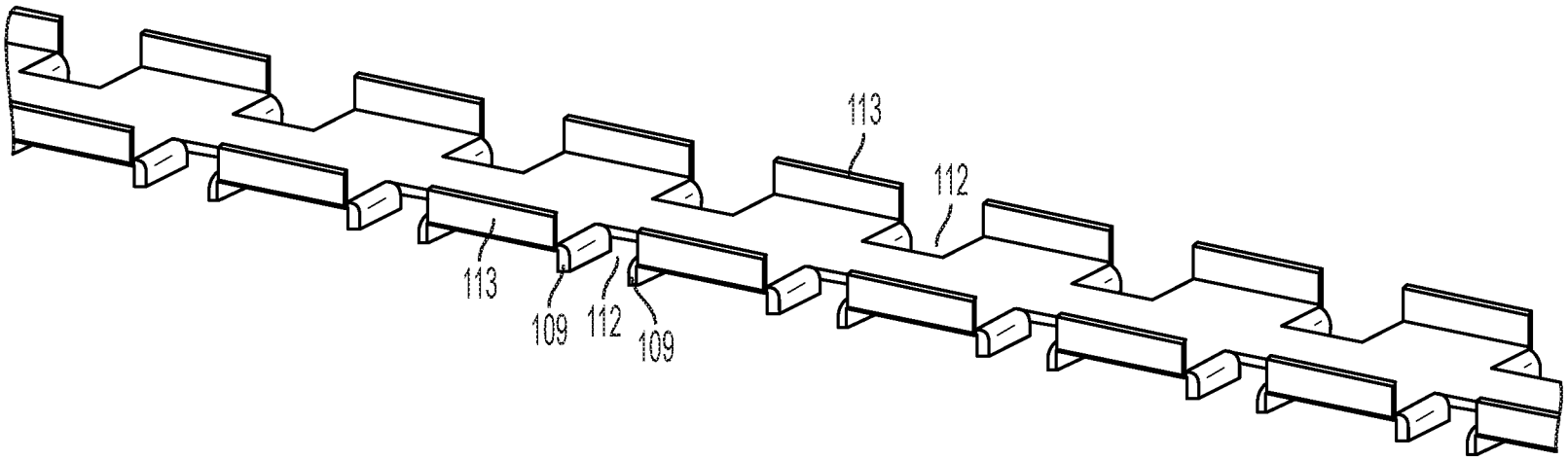
FIG. 4 is a schematic view of section of fin inside one embodiment of the condenser of the present invention.

One embodiment of a single fin of the present invention is represented in FIG. 4. In between a pair of flanges 109 is an opening 112 in the fin. The opening 112 can freely allow liquid and vapor to travel across channels. In the first orientation, these openings 112 aid in liquid drainage from the main surface of the fin, helping keep the liquid height minimal and promoting condensation heat transfer.

The ends of the fin 113 are folded over, creating a large surface to bond with the first cover 110 and second cover 111. The bonding may be accomplished via thermally conductive adhesives, soldering, brazing or other processes known in the art. The material of the fins and cover can be aluminum, copper or other thermally-conductive material.

Figure 5:
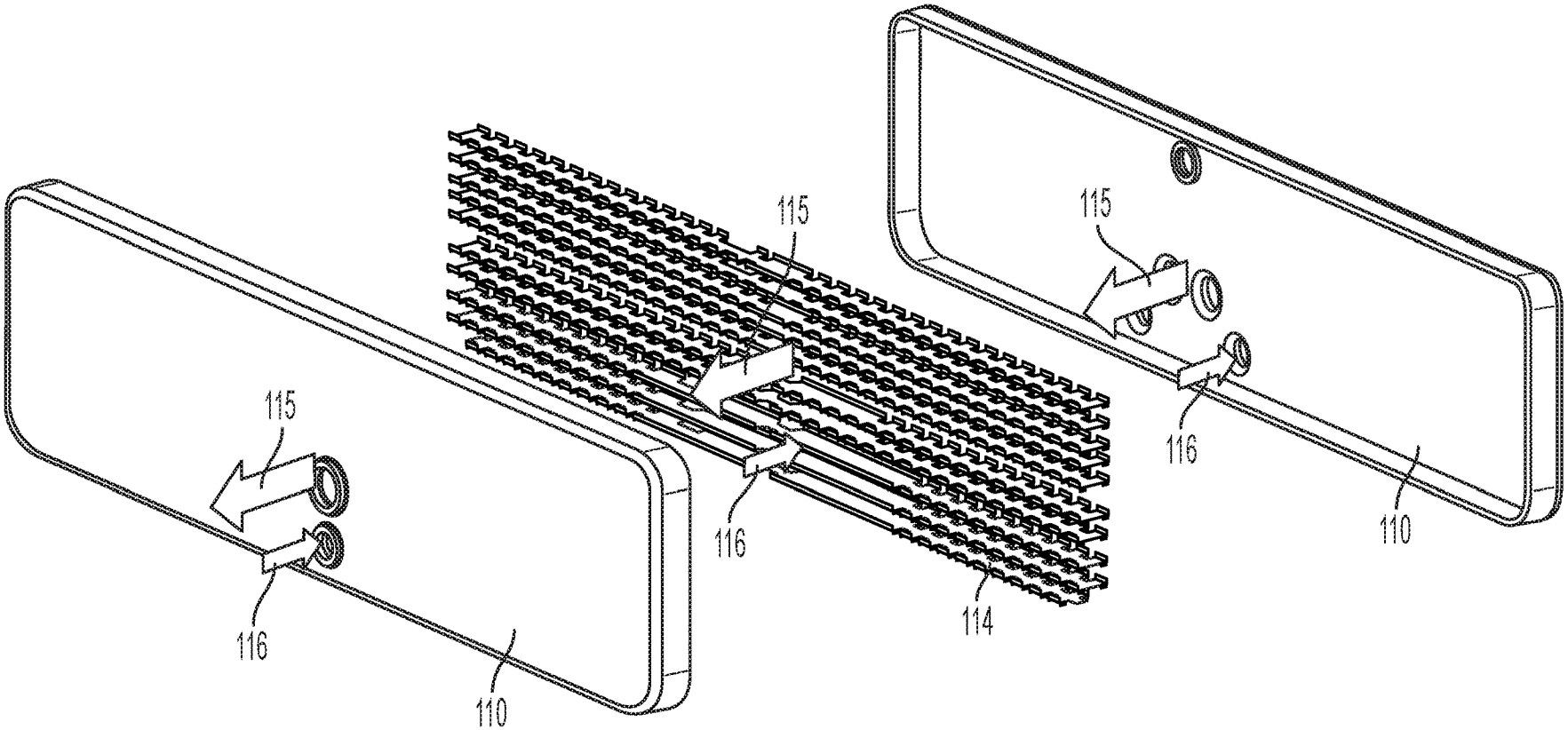
FIG. 5 is an exploded schematic view of a condenser core of one embodiment of the present invention.

The general construction of a condenser is presented in an exploded view in FIG. 5, with a fin stack 114, comprising of interlocked fins 108, a first cover 110 and a second cover 111. The flow pattern of the refrigerant (vapor and/or liquid) is represented by arrows, indicated vapor flows 115 and liquid flows 116. In this embodiment vapor and liquid enter and exit normal to the first cover 110 and second cover 111. The length of the channels in this embodiment is approximately 240 mm, and the fin stack 114 height is approximately 60 mm. Typical length of channels may vary from as low as 100 mm up to 600 mm or more. In various embodiments, the fin stack 114 height may vary from 20 mm up to 150 mm.

Figure 6:
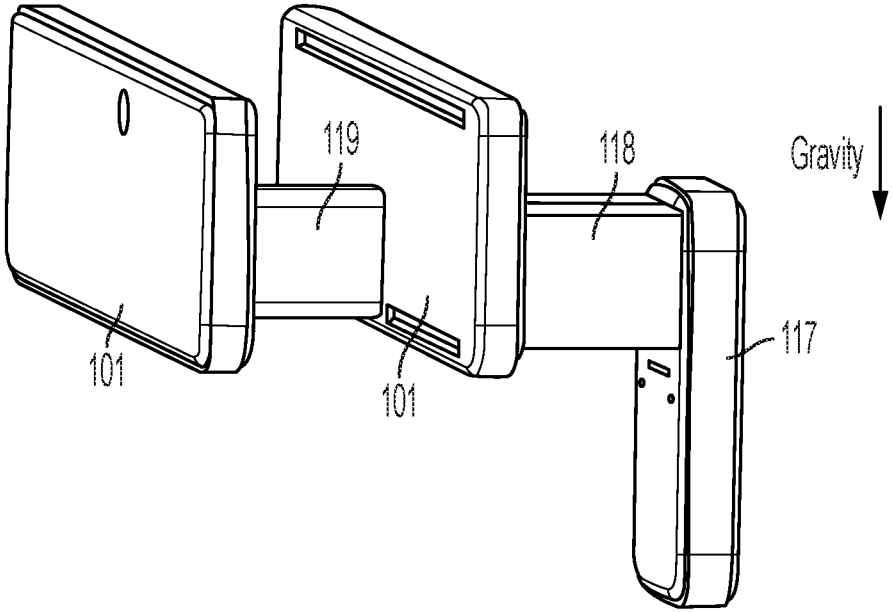
FIG. 6 is a schematic view of a thermosyphon unit with two condenser cores of one embodiment of the present invention in a first orientation.

The integration of the condenser 101 in the first orientation, into a thermosyphon, is presented in FIG. 6. In this embodiment, there are two condensers 101, an evaporator 117, an evaporator-to-condenser fluid coupling 118, and an inter-condenser fluid coupling 119. Vapor and liquid can travel counter to each other in separate passages in the evaporator to condenser fluid coupling 118, as well as the inter-condenser coupling 119. The same thermosyphon unit in a second orientation is presented in FIG. 7

Figure 8:
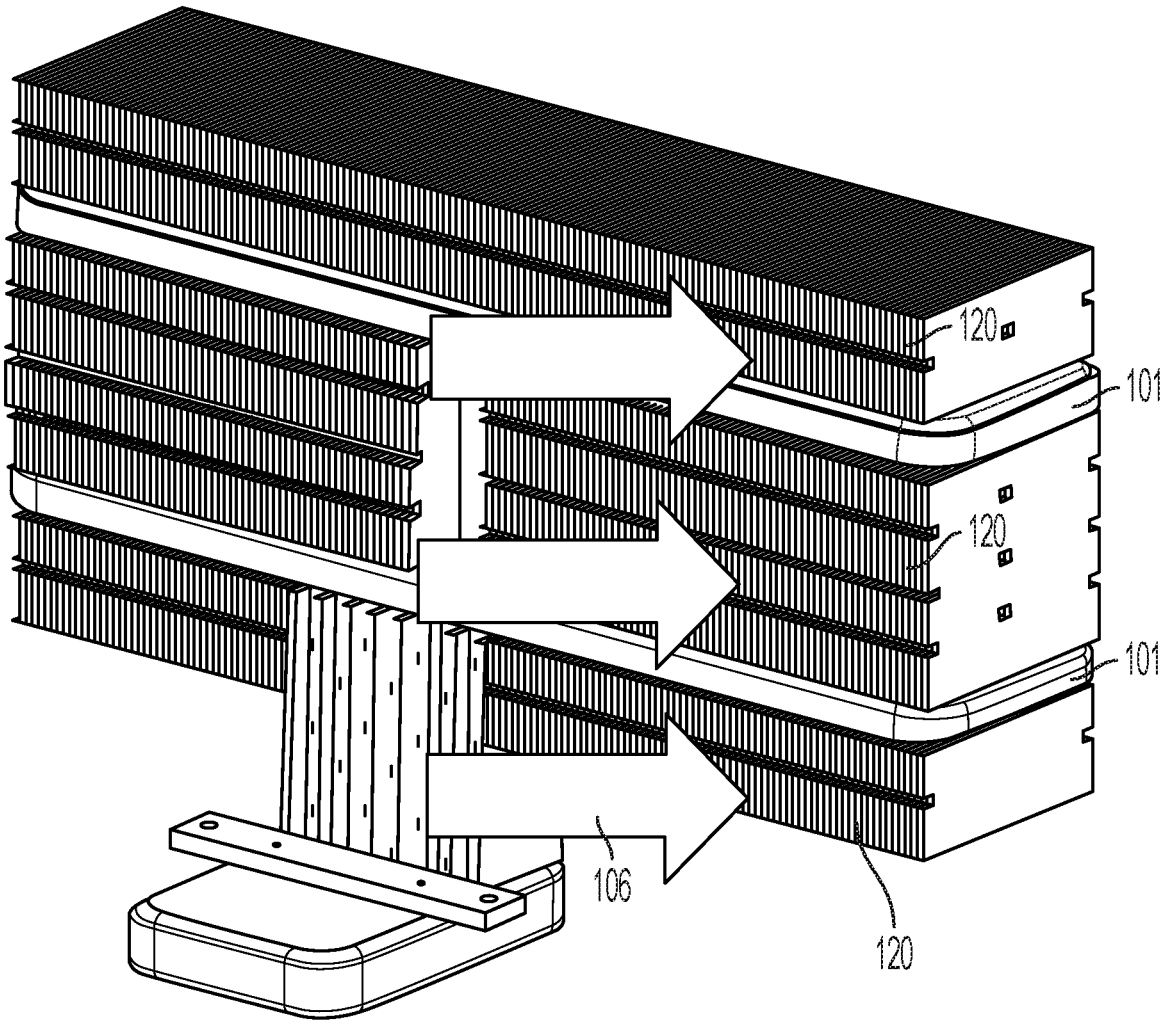
FIG. 8 is a schematic view of a thermosyphon unit with two condenser cores of one embodiment of the present invention in a second orientation with heat transfer fins to enhance the air side heat removal.

Another embodiment of the thermosyphon unit in a second orientation is presented in FIG. 8, which includes external condenser heat transfer fins 120, intended to aid in the heat removal of a coolant 106, mainly air, passing over the condenser 101.

Figure 7:
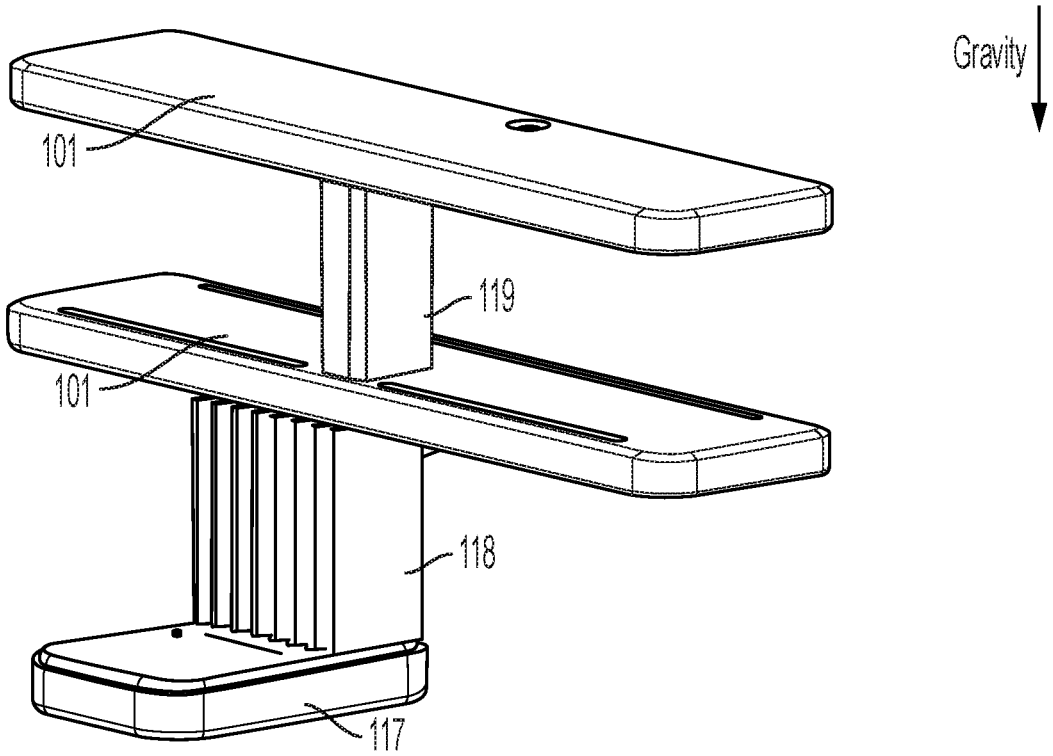
FIG. 7 is a schematic view of a thermosyphon unit with two condenser cores of one embodiment of the present invention in a second orientation.
Figure 9:
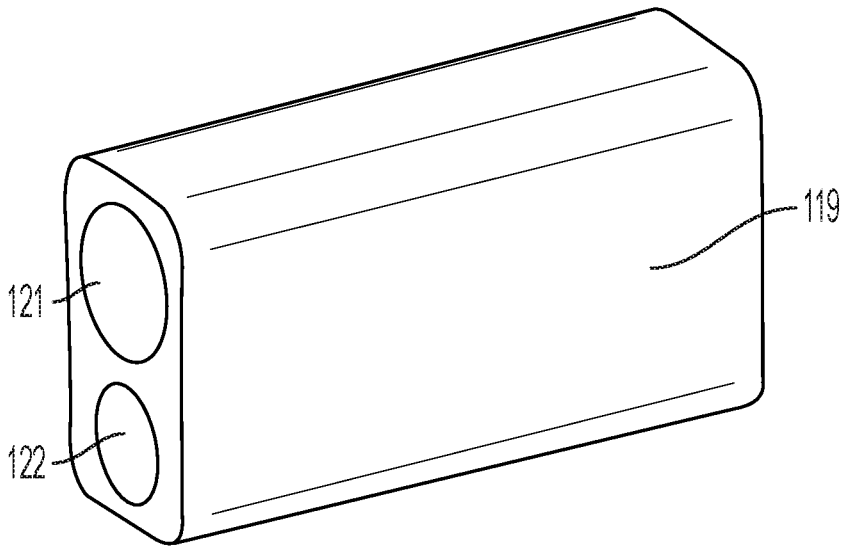
FIG. 9 is a schematic view of an inter-condenser fluid coupling used in one embodiment of the present invention.

An isometric view of the inter-condenser fluid coupling 119 is presented in FIG. 9. The inter-condenser fluid coupling 119 has a vapor passageway 121 as well as a liquid passageway 122. The position of the inter-condenser fluid coupling 119 may be centrally located in the condenser 101, and may allow fluid to distribute between multiple condenser 101 sections, to disperse flow in a parallel fashion. In this embodiment, the location is in lieu of headers in a typical condenser positioned at the lateral ends of a typical condenser assembly. The positioning of the inter-condenser coupling 119 on the first cover 110 and second cover 111 is important when the unit is operating in the second orientation, where the axis of the vapor passageway 121 is parallel, or nearly parallel, to gravity, as shown in FIG. 7. During an initial condition in the second orientation, the condenser 101 that is at a lower elevation will tend to be flooded with liquid. Since vapor passes through the condenser 101 at the lower elevation prior to entering the inter-condenser fluid coupling 119, it will carry liquid with it as it passes to the condenser 101 at the higher elevation. This bubble pumping effect will aid in more evenly distributing the liquid in both the lower and upper condensers. The impact of evenly distributing the liquid is that vapor will be exposed to the fins 113 inside of the condenser, which is a necessary requisite to get condensation heat transfer.

In the embodiments presented, two condensers 101 are presented, while it is possible to increase the number to three or any other number. Also, it is possible to have multiple inter-condenser fluid couplings, while in many embodiments they will interface on the first cover 110 and second cover 111 of the condenser 101.

Figure 10:
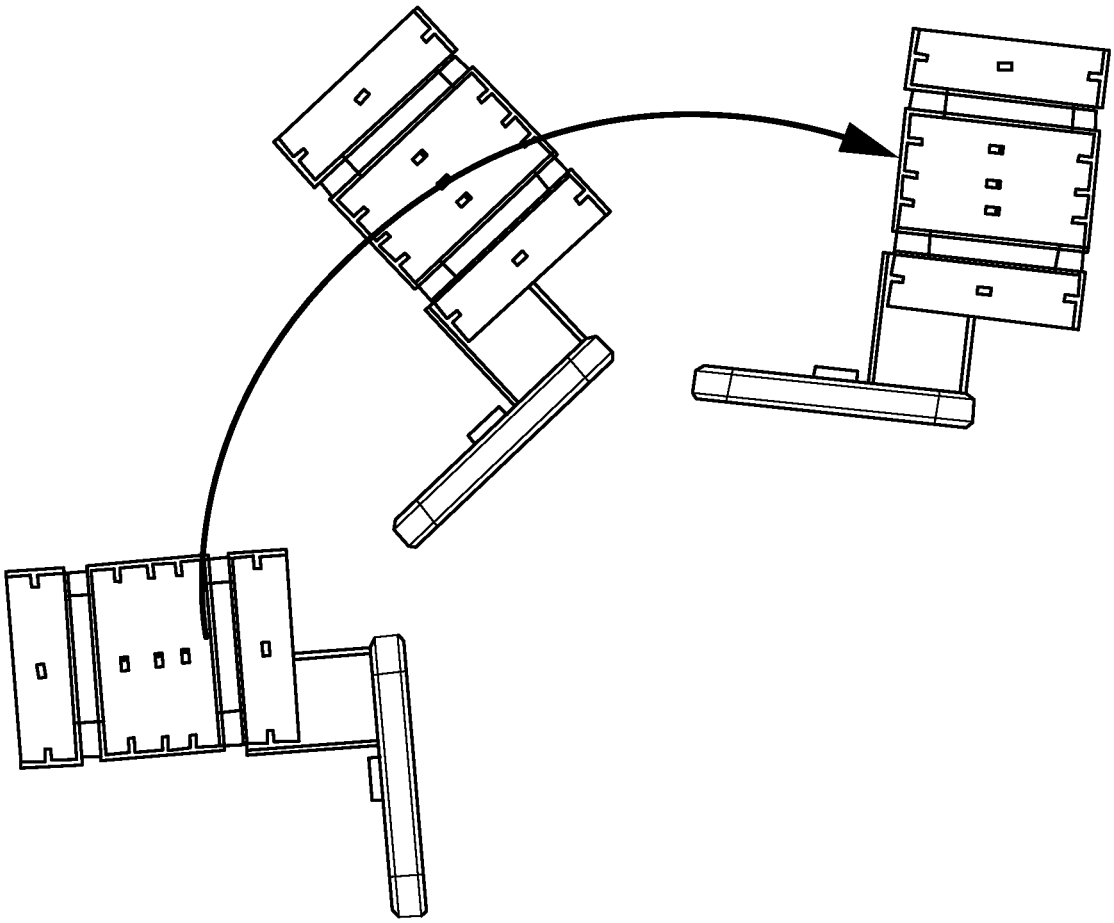
FIG. 10 is a schematic view of the acceptable operating orientations of a thermosyphon unit.

While two orientations are focused on in the description, the present invention can work in a continuous sweep of orientations as presented in FIG. 10. The condenser second cover 111 can go slightly beyond a 90-degree sweep where it starts at parallel with gravity to perpendicular with gravity.

While the present system and method has been disclosed according to the preferred embodiment of the invention, those of ordinary skill in the art will understand that other embodiments have also been enabled. Even though the foregoing discussion has focused on particular embodiments, it is understood that other configurations are contemplated. In particular, even though the expressions "in one embodiment" or "in another embodiment" are used herein, these phrases are meant to generally reference embodiment possibilities and are not intended to limit the invention to those particular embodiment configurations. These terms may reference the same or different embodiments, and unless indicated otherwise, are combinable into aggregate embodiments. The terms "a", "an" and "the" mean "one or more" unless expressly specified otherwise. The term "connected" means "communicatively connected" unless otherwise defined.

When a single embodiment is described herein, it will be readily apparent that more than one embodiment may be used in place of a single embodiment. Similarly, where more than one embodiment is described herein, it will be readily apparent that a single embodiment may be substituted for that one device.

In light of the wide variety of methods for heat transfer inside a condenser known in the art, the detailed embodiments are intended to be illustrative only and should not be taken as limiting the scope of the invention. Rather, what is claimed as the invention is all such modifications as may come within the spirit and scope of the following claims and equivalents thereto.

None of the description in this specification should be read as implying that any particular element, step or function is an essential element which must be included in the claim scope. The scope of the patented subject matter is defined only by the allowed claims and their equivalents. Unless explicitly recited, other aspects of the present invention as described in this specification do not limit the scope of the claims.

What is claimed is:

1. A thermosyphon, comprising:

an evaporator fluidly coupled to a first condenser, the first condenser is configured with a plurality of fins, with each of the plurality of fins having one or more notches adjacent to one or more flanges, the one or more notches forming one or more vapor flow channels through the plurality of fins;

the first condenser being fluidly coupled to a second condenser;

wherein vapor flowing from the evaporator must first pass through the first condenser before entering the second condenser; and wherein a coupling between the first condenser and the second condenser includes both a vapor passage and a liquid passage.

2. The thermosyphon of claim 1, wherein the one or more vapor flow channels have rectangular shapes.

3. The thermosyphon of claim 1, wherein the one or more vapor flow channels are parallel.

4. The thermosyphon of claim 1, wherein the one or more flanges each occupy only a portion of each of the one or more fins.

5. The thermosyphon of claim 1, wherein the plurality of fins are positioned between a first cover and a second cover to form the first condenser.

6. The thermosyphon of claim 5, wherein the one or more flanges are each positioned on each of the one or more fins proximal to the first cover.

7. The thermosyphon of claim 5, wherein each of the one or more flow channels have two side surfaces that are perpendicular to the first cover.

8. The thermosyphon of claim 5, wherein the thermosyphon operates using gravity without mechanical force.

9. The thermosyphon of claim 1, wherein the second condenser is configured with a plurality of fins, with each fin having one or more notches adjacent to one or more flanges, the one or more notches forming one or more vapor flow channels through the plurality of fins.

* * * * *